US005836397A

United States Patent [19]

Craig et al.

[11] Patent Number: 5,836,397

[45] Date of Patent: Nov. 17, 1998

[54] HEAD-LOCK FIRE SPRINKLER SYSTEM

[76] Inventors: Darin I. Craig, 60 Caesar Pl.; Rick S. Foster, 263 Pacific, both of Lake Havasu City, Ariz. 86406

[21] Appl. No.: 746,807

[22] Filed: Nov. 18, 1996

[51] Int. Cl.[6] ..... A62C 35/58

[52] U.S. Cl. ..... 169/5; 169/37

[58] Field of Search ..... 169/43, 46, 5, 169/16, 17, 18, 37, 38, 39, 40, 41, 90; 239/600; 285/376

[56] References Cited

U.S. PATENT DOCUMENTS 4,527,745 7/1985 Butterfield et al. ..... 239/600

*Primary Examiner*—Andrew C. Pike

*Attorney, Agent, or Firm*—Harry M. Weiss; Jeffrey D. Moy; Harry M. Weiss & Associates, P.C.

[57] ABSTRACT

A fire sprinkler system and method comprising a plurality of water conduits having mounted thereon a plurality of sprinkler assembly receivers, and, removably coupled to the sprinkler assembly receivers, a plurality of bayonet-type quick release removable and locking sprinkler assemblies.

1 Claim, 1 Drawing Sheet

HEAD-LOCK FIRE SPRINKLER SYSTEM

FIELD OF THE INVENTION

This invention relates to fire sprinkler systems of the type that comprise a water distribution conduit system to which is mounted a plurality of sprinkler assemblies and, more particularly, to a quick-release fire sprinkler assembly and method therefor.

BACKGROUND OF THE INVENTION

Automatic fire sprinklers have been in use in the U.S. since 1874. Fire sprinklers are widely recognized as the single most effective method for fighting the spread of fires in their early stages—before they can cause severe injury to people and damage to property. When one fire sprinkler head is activated to fight a fire, the entire sprinkler system does not automatically activate. Instead, sprinklers react to temperatures in individual rooms. The chances of a fire sprinkler accidentally going off are extremely remote.

More than 200 U.S. communities have residential sprinkler laws. In downtown Fresno for example, there has been fire damage of only $42,000 during a 10-year period in which its sprinklering law has been in effect. According to the National Fire Protection Association, property damage in hotel fires was 78% less in structures with sprinklers than it was in structures without sprinklers during the years 1983–87. The average loss per fire was $2,300 in sprinklered buildings and $10,300 in unsprinklered buildings. Nearly half of all hotels and motels, according to a 1988 survey by NFPA, have sprinkler systems.

Automatic sprinkler systems have enjoyed an enviable record of protecting life and property for more than 100 years. Water damage from a home sprinkler system will be much less severe than the damage caused by water from firefighting hose lines or smoke and fire damage if the fire goes unabated. Quick response sprinklers release 8–24 gallons of water per minute compared to 50–125 gallons per minute released by a fire hose.

The sprinkler head portions of sprinkler assemblies are individually activated by fire. Residential fires are usually controlled with one sprinkler head. Ninety percent of all fires are controlled with six or fewer heads, and more than 80% of fires which occur are controlled by two or fewer sprinklers. Sprinklers provide a high level of life safety. Statistics demonstrate that there has never been any multiple loss of life in a fully sprinklered building. The combination of automatic sprinklers and early warning systems in all buildings and residences could reduce overall injuries, loss of life, and property damage by at least 50%.

Periodically, it is necessary to change individual sprinkler heads or sprinkler assemblies in a fire sprinkler system. In most systems currently in use, each sprinkler assembly—comprising a base and head or nozzle—is screwed directly into the conduit or into a base member coupled to the conduit. In order to prevent leaking, plumber's tape or similar adhesive material is typically wrapped around the threaded base of the sprinkler assembly before insertion. This process can be time-consuming and labor-intensive. Moreover, during insertion of the assembly into the conduit or base member, a portion of the tape can break away and clog the assembly—limiting or preventing the flow of water from the conduit and out the sprinkler head.

Some efforts have been made to improve this aspect of fire sprinkler systems. These efforts, however, have focused on the head or nozzle portion of the sprinkler assembly. For example, U.S. Pat. No. 4,185,781 discloses a quick disconnect nozzle wherein a separate O-ring sealing member and a separate pressure applying spring are utilized. U.S. Pat. No. 4,438,884 discloses a quick disconnect nozzle incorporating a tubular shaped combination seal and pressure exerting member. U.S. Pat. No. 4,527,745 also discloses a quick disconnect nozzle assembly, which has particular applicability for agricultural uses, and which has camming surfaces adapted for drawing the mating nozzle tip and body parts together against an interposed sealing member in response to rotation of the nozzle tip, without the necessity for simultaneous manual axial forcing of the tip against the sealing member. U.S. Pat. No. 4,738,401 similarly features camming surfaces to draw the nozzle tip and body together while compressing a tubular configured sealing member with only rotational forces being applied to the tip. U.S. Pat. No. 5,415,348 also discloses a quick change and easily identifiable nozzle construction for use in modular sprinkler assembly. U.S. Pat. No. 5,333,790 to Christopher discloses a quick disconnect nozzle apparatus which allows any of a plurality of nozzles to be quickly secured to and removed from a fixed nozzle base, to meet the requirements of different types of aerial spray operations or provide different spray patterns.

From the foregoing survey of the prior art, it will be apparent that while a great variety of quick release sprinkler heads or nozzles are known, each of these designs provides only for the quick release of the sprinkler head or nozzle—but not the sprinkler assembly as a whole. These prior art designs still provide sprinkler assemblies with grooved bases, which bases are inserted into a conduit. See, e.g., U.S. Pat. No. 5,415,348 (FIG. 1 thereof); U.S. Pat. No. 5,333,790 (FIG. 2 thereof); U.S. Pat. No. 5,190,224 (FIG. 1 thereof). Thus, none of these prior art designs provides a quick release assembly or base, and none of these eliminates the need for the use of sealing tape around the grooved base of the sprinkler assembly, so as to prevent fluid from leaking from the conduit. Moreover, these prior art designs are complicated and relatively expensive to construct.

SUMMARY OF THE INVENTION

It is an object of this invention to provide a quick release fire sprinkler head that is economical and easy to use so as to provide a system which comprises a fire extinguisher water distribution system having a plurality of standard receptacles built into it and a plurality of quick release, interchangeable fire spray assemblies so as to permit the placement of an assembly having the desired spray characteristics for each location.

It is an object of the present invention to provide an improved fire sprinkler system and method therefor.

It is a further object of the present invention to provide an improved fire sprinkler system wherein an entire fire sprinkler apparatus, comprising a base and head or nozzle, may be quickly released from a receiver assembly attached to the surface of a conduit.

BRIEF DESCRIPTION OF THE PREFERRED EMBODIMENTS

In accordance with one embodiment of the present invention, an improved fire sprinkler system is disclosed. The fire sprinkler system comprises, in combination: at least one water conduit; a plurality of openings in each conduit; a plurality of receiver means coupled to an outer surface portion of each conduit, each of the plurality of receiver means being in fluid communication with each conduit through one of the plurality of openings; means located in each of the receiver means for receiving in a quick-release manner a sprinkler assembly; a plurality of sprinkler assemblies; and means located on each of the sprinkler assemblies for releasably coupling in a quick release manner each of the sprinkler assemblies in fluid communication with each of the receiver means.

In accordance with another embodiment of the present invention, a fire sprinkler system is disclosed. The fire sprinkler system comprises, in combination: a plurality of water conduits having passages through the walls thereof at predetermined points; a plurality of sprinkler assembly receivers mounted in the conduit system enclosing the wall passages; a multiplicity of sprinkler assemblies removably attached to the sprinkler assembly receivers for creating a spray or mist of water when the system is activated: the sprinkler assembly receivers being so constructed and configured as to form an interior passage defined by a cylindrical wall in fluid communication with the wall passages; the cylindrical wall having formed therein at least one bayonet type fastener slot having an entry portion generally parallel to the axis of the cylindrical wall and a locking portion generally perpendicular to the axis of the cylindrical wall; and the sprinkler assembly comprising: a cylindrical insert having a water passage axially formed therethrough in fluid communication with the wall passages; valve means closing the water passage to flow; means for forming a water spray or mist when the system is activated; a fusible link for opening the water passage to flow when the fusible link is heated to a predetermined temperature; and at least one bayonet pin extending from the cylindrical insert for beirg received in the bayonet slot in the receptacle wall for selectively locking the sprinkler head in the receptacle and, respectively, for permitting removal of the sprinkler head from the receptacle.

In accordance with a further embodiment of the present invention, an improved method for replacing sprinkler assemblies is disclosed. The method comprises the steps of: providing at least one water conduit; providing a plurality of openings in each conduit; providing a plurality of receiver means coupled to an outer surface portion of each conduit, each of the plurality of receiver means being in fluid communication with each conduit through one of the plurality of openings; providing means located in each of the receiver means for receiving in a quick release manner a sprinkler assembly; providing a plurality of sprinkler assemblies; and providing means located on each of the sprinkler assemblies for releasably coupling in a quick release manner each of the sprinkler assemblies in fluid communication with each of the receiver means.

In accordance with still a further embodiment of the present invention, an improved method for replacing sprinkler assemblies is disclosed. The method comprises the steps of: providing a plurality of water conduits having passages through the walls thereof at predetermined points; providing a plurality of sprinkler assembly receivers mounted in the conduit system enclosing the wall passages; providing a multiplicity of sprinkler assemblies removably attached to the sprinkler assembly receivers for creating a spray or mist of water when the system is activated; the sprinkler assembly receivers being so constructed and configured as to form an interior passage defined by a cylindrical wall in fluid communication with the wall passages; the cylindrical wall having formed therein at least one bayonet type fastener slot having an entry portion generally parallel to the axis of the cylindrical wall and a locking portion generally perpendicular to the axis of the cylindrical wall; and the sprinkler assembly comprising: a cylindrical insert having a water passage axially formed therethrough in fluid communication with the wall passages; valve means closing the water passage to flow; means for forming a water spray or mist when the system is activated; a fusible link for opening the water passage to flow when the fusible link is heated to a predetermined temperature; and at least one bayonet pin extending from the cylindrical insert for being received in the bayonet slot in the receptacle wall for selectively locking the sprinkler head in the receptacle and, respectively, for permitting removal of the sprinkler head from the receptacle.

DETAILED DESCRIPTION OF THE PREFERRED EMBODIMENTS

Figure 1:
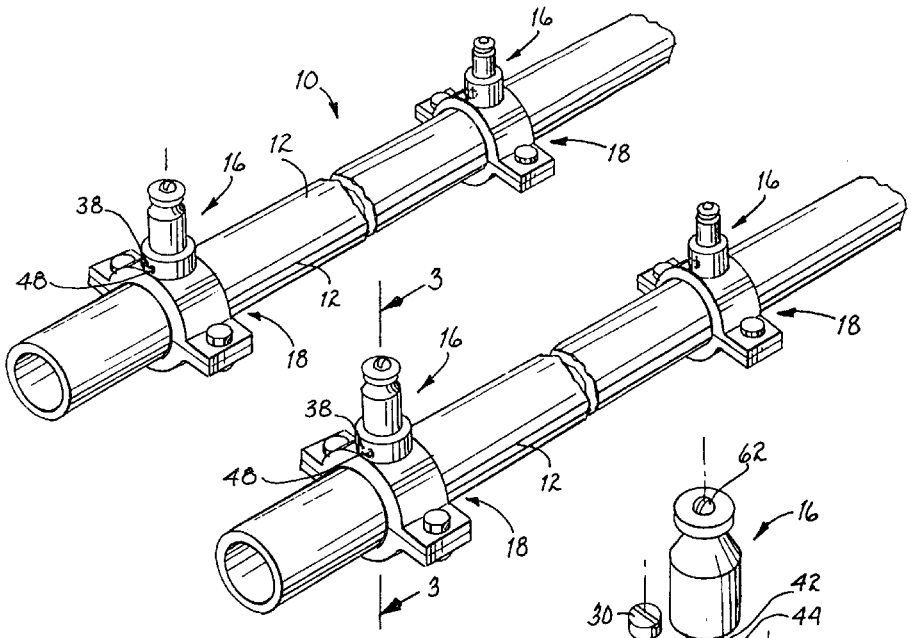
FIG. 1 depicts a portion of a fire sprinkler system that comprises at least two conduits, two portions of which are shown in exploded view, and a plurality of sprinkler receivers with sprinkler assemblies inserted therein.

The drawing and the following description are of the preferred but not the only embodiment of the invention and, thus, are not limiting. The invention may be used with any of several spray and mist forming heads and the receptacles may be secured to or built into the system in any of several ways without departing from the invention.

Figure 2:
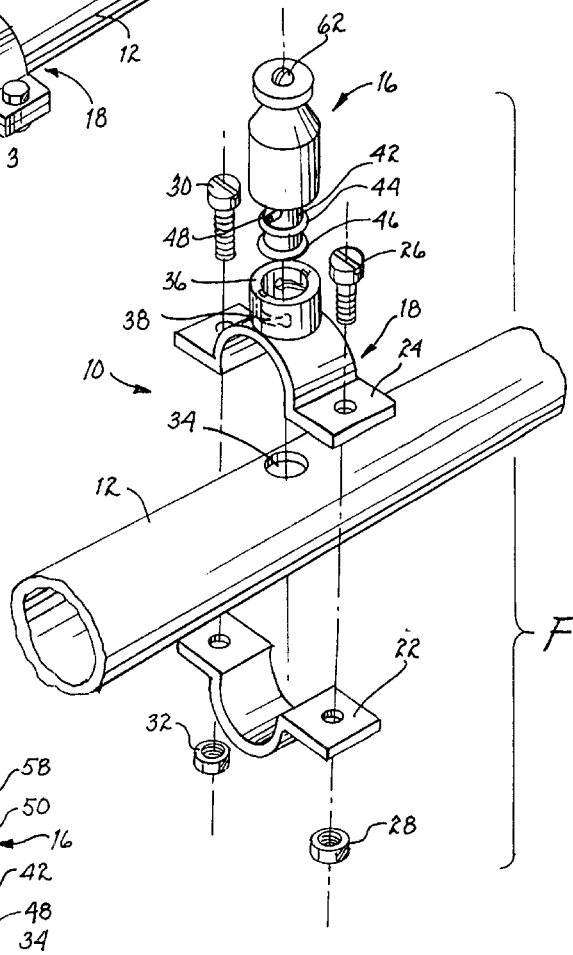
FIG. 2 is an exploded view of one portion of a sprinkler system showing a single sprinkler receiver and sprinkler assembly.
Figure 3:
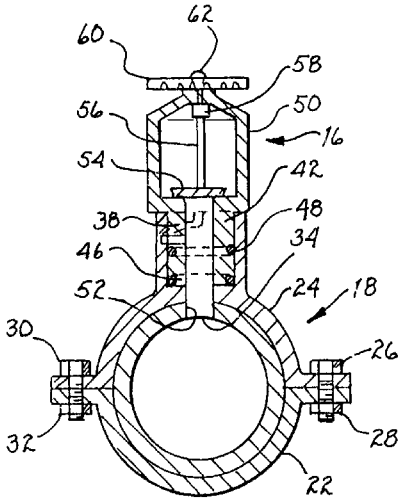
FIG. 3 is a cross section of a sprinkler receiver and assembly connected to the conduit system taken along lines 3—3 in the direction of the arrows 3—3 as shown in FIG. 1

Referring to FIGS. 1–3, reference number 10 refers generally to the fire sprinkler system of this invention. The system 10 comprises conduits 12 which typically have several segments defining, usually, a grid pattern. The system 10 further comprises a plurality of sprinkler assemblies 16 comprising base and head or nozzle portions. Each sprinkler assembly 16 is received in a receiver assembly 18.

Figure 4:
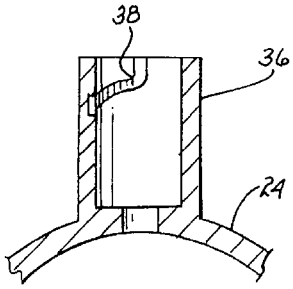
FIG. 4 is an enlarged partial cross-sectional view of a sprinkler receiver.

The manner in which each sprinkler assembly 16 is received in a receiver assembly 18 is shown in FIG. 2. In this non-limiting example, a receiver assembly 18 comprises lower and upper saddle brackets 22 and 24 that are secured to the conduit 12 by a pair of bolt and nut assemblies, as depicted at 26 and 28 and at 30 and 32. A passage 34 through the wall of the conduit 12 permits water to flow to a cylindrical head receptacle 36 of the receiver assembly 18, which is clamped to the conduit 12 by the saddle clamp assembly just described. Preferably two bayonet slots 38 are formed through opposing sides of the cylindrical head receptacle 36, and face in opposing directions. As is the nature of a bayonet slot and as also shown in FIG. 4, the slots 38 extend generally parallel to the axis of the cylindrical head receptacle 36 and then generally laterally thereof.

Still referring to FIG. 2, a sprinkler assembly 16 is constructed and configured to be removably received in liquid sealing relationship in the head receptacle 36 and to be locked therein by means of the bayonet slots formed therein. The sprinkler assembly 16 comprises a cylindrical insert 42 constructed and configured to receive sealing means such as O-rings 44 and 46, and has, extending from an outer wall thereof, two bayonet pins 48 configured to be received in the corresponding bayonet slots 38 in the head receptacle 36. When the bayonet pins 48 are received in the bayonet slots 38, they extend outside of the head receptacle 36, as shown in FIGS. 1 and 3. In this manner, the sprinkler assembly 16 may be installed or removed with the use of a grasping tool (not shown), which tool may for example comprise a cylinder having an internal diameter greater than the external diameter of the sprinkler assembly 16 and bayonet slots 38 for gripping the bayonet pins 48. Use of such a tool, which is only made possible by having the bayonet pins 48 extend outside of the head receptacle 36, permits the installation and removal of the sprinkler assembly 16 with less strain on the bayonet pins 48 than if the sprinkler assembly 16 itself had to be grasped and turned for installation and removal. There is another advantage to having the bayonet pins 48 extend outside of the head receptacle 36. In this manner, a user can confirm whether the sprinkler assembly 16 has been properly installed simply by looking at the position of the bayonet pins 48 along the bayonet slots 38—there is no need to grasp the sprinkler assembly 16 to determine if it has been properly secured into position.

Referring now to FIG. 3, a housing 50 of the sprinkler assembly 16 is so constructed as to be connectable through a passage 52 extending through insert 42 and through the passage 34 for receiving water from the conduit 12. The upper end of the passage 52 is closed by a valve member 54 held in fluid sealing relationship therewith by a fusible link 56 and a keeper 58. A spray or mist forming disk 60 is mounted at the distal end of the sprinkler assembly 16 by a screw 62, or other fastening means.

The sprinkler assembly 16 is normally closed flow therethrough. When the temperature of the sprinkler assembly 16 reaches a predetermined point, the fusible link 56, which is made of a low-melting alloy or other low melting or low temperature softening material, melts or softens, thereby releasing the valve 54 thereby opening the passage 34. Water flows through the housing 50 and around the keeper 58 impinging through an opening in the distal end of housing 50 on the disk 60 and being dispersed as a spray or mist, according to the design of the disk. This mode of action, the use of a fusible link, etc., is standard in the industry.

The O-rings 44 and 46 form a liquidtight seal between the sprinkler assembly 16 and the receiver assembly 18. Before water pressure is applied to the system 10, or during maintenance when no water is applied, the bayonet fastener arrangement permits quick and easy removal and replacement of the sprinkler assembly 16, as there is little frictional or other retaining force. When water pressure is applied, the force of the water pressure on the head locks the bayonet pins 48 in the bayonet slots 38 making it nearly impossible to remove the sprinkler assembly 16 using normal human exerted forces.

The system of this invention can be installed very economically and, at the same time, provides great flexibility in the placement of specifically designed sprinkler heads to maximize the fire suppression capability of the system.

While the invention has been particularly shown and described with reference to preferred embodiments thereof, it will be understood by those skilled in the art that the foregoing and other changes in form and details may be made therein without departing from the spirit and scope of the invention. For example, it would be possible to construct the system 10 of the present invention with only one bayonet slot 38 and only one corresponding bayonet pin 48, or to construct the bayonet slots 38 so that they are recessed into the interior of the head receptacle 36 rather than cut all of the way through the head receptacle. If constructed in this fashion, the bayonet pin 48 would lock into position in the same manner, but the bayonet pin would not extend beyond the head receptacle 36.

INDUSTRIAL APPLICATION

This invention is useful in the fire sprinkler industry.

What is claimed is:

1. A fire sprinkler system comprising, in combination:

a plurality of water conduits having passages through walls thereof at predetermined points;

a plurality of sprinkler assembly receivers each mounted in each one of said conduits enclosing said passages; and a multiplicity of sprinkler assemblies removably attached to said plurality of sprinkler assembly receivers for creating a spray or mist of water when the fire sprinkler system is activated;

each one of said plurality of sprinkler assembly receivers being so constructed and configured as to form an interior passage provided by a cylindrical wall in fluid communication with a respective said passage;

each said cylindrical wall having formed therein at least one bayonet-type fastener slot having an entry portion generally parallel to an axis of the cylindrical wall thereof and a locking portion generally perpendicular to the axis of the cylindrical wall thereof;

each one of said multiplicity of sprinkler assemblies comprising:

a cylindrical insert having a water passage axially formed therethrough in fluid communication with said respective passage;

valve means for closing said water passage to flow;

means for forming a water spray or mist when the fire sprinkler system is activated;

fusible link means for opening the water passage to flow when the fusible link means is heated to a predetermined temperature; and at least one bayonet pin extending from the cylindrical insert capable of being received in said bayonet-type fastener slot in each said cylindrical wall for selectively locking each one of said sprinkler assemblies in an associated said receiver and, respectively, for permitting removal of each said sprinkler assembly from said associated receiver.

* * * * *